US012696952B2

(12) United States Patent
Werremeyer et al.

(10) Patent No.: US 12,696,952 B2
(45) Date of Patent: Aug. 4, 2026

(54) FOOTWEAR SOLE ASSEMBLY

(71) Applicant: Xelero Technology, LLC, Hillsborough, NJ (US)

(72) Inventors: Daniel Werremeyer, Hillsborough, NJ (US); Robert Tighe, Easton, PA (US)

(73) Assignee: Xelero Technology, LLC, Hillsborough, NJ (US)

( * ) Notice: Subject to any disclaimer, the term of this patent is extended or adjusted under 35 U.S.C. 154(b) by 0 days.

(21) Appl. No.: 19/294,968

(22) Filed: Aug. 8, 2025

(65) Prior Publication Data

US 2026/0041194 A1 Feb. 12, 2026

Related U.S. Application Data

(60) Provisional application No. 63/681,212, filed on Aug. 9, 2024.

(51) Int. Cl.
*A43B 13/12* (2006.01)
*A43B 13/14* (2006.01)
*A43B 13/18* (2006.01)

(52) U.S. Cl.
CPC ..... *A43B 13/12* (2013.01); *A43B 13/143* (2013.01); *A43B 13/148* (2013.01); *A43B 13/183* (2013.01)

(58) Field of Classification Search
CPC ..... A43B 13/12; A43B 13/143; A43B 13/148; A43B 13/183
USPC ..... 36/25 R
See application file for complete search history.

(56) References Cited

U.S. PATENT DOCUMENTS

| | | | | |
|---|---|---|---|---|
| 4,821,432 | A * | 4/1989 | Reiber | A43B 7/1464 36/110 |
| 5,572,805 | A * | 11/1996 | Giese | A43B 13/188 36/31 |
| 8,316,558 | B2 | 11/2012 | Teteriatnikov et al. | |
| 8,474,154 | B2 | 7/2013 | Werremeyer et al. | |
| 2005/0198863 | A1* | 9/2005 | Hockerson | A43B 5/06 36/25 R |
| 2006/0191163 | A1* | 8/2006 | Nakano | A43B 13/12 36/30 R |
| 2009/0241372 | A1* | 10/2009 | Ryu | A43B 7/144 36/43 |
| 2009/0307925 | A1* | 12/2009 | Pfister | A43B 7/223 36/43 |
| 2011/0035960 | A1* | 2/2011 | Werremeyer | A43B 13/12 36/28 |
| 2012/0060395 | A1* | 3/2012 | Blevens | A43B 13/18 36/35 R |

(Continued)

*Primary Examiner* — Marie D Bays
(74) *Attorney, Agent, or Firm* — Michael J. Brown

(57) ABSTRACT

A sole assembly for footwear includes a footbed made of a first resilient material with a lower durometer than a surrounding rocker frame composed of a second resilient material. During a user's heel-to-toe motion, medial and lateral rolling elements extending downward from the frame form convex longitudinal curves from heel to midfoot, guiding the transition from heel strike to toe-off. Beneath the footbed, a rigid support plate with medial and lateral extensions is incorporated to provide torsional stability and to restrict forefoot flexion, reducing pronation and supination while centering the foot. As a result, energy is stored during gait and released to propel the user, supporting a controlled, dynamic rolling gait during walking or running.

11 Claims, 4 Drawing Sheets

(56) References Cited

U.S. PATENT DOCUMENTS

| | | | | |
|---|---|---|---|---|
| 2012/0297641 | A1* | 11/2012 | Pfister | B29D 35/142 36/43 |
| 2015/0040432 | A1* | 2/2015 | Berend | A43B 13/20 36/102 |
| 2015/0040435 | A1* | 2/2015 | Barnes | A43B 13/22 36/102 |
| 2015/0089834 | A1* | 4/2015 | Baum | A43B 13/181 36/27 |
| 2016/0345668 | A1 | 12/2016 | Dyer et al. | |
| 2018/0192734 | A1* | 7/2018 | Möhlmann | A43B 7/082 |
| 2019/0104805 | A1* | 4/2019 | Del Biondi | A43B 13/125 |
| 2019/0159547 | A1* | 5/2019 | Nakatsuka | A43B 13/185 |
| 2019/0289959 | A1* | 9/2019 | Matsui | A43B 13/14 |
| 2022/0022595 | A1* | 1/2022 | Girard | A43B 13/122 |
| 2022/0053879 | A1* | 2/2022 | Redon | A43B 13/183 |
| 2023/0255308 | A1* | 8/2023 | Bidal | A43B 5/001 36/127 |
| 2024/0268519 | A1 | 8/2024 | Werremeyer et al. | |
| 2024/0306764 | A1* | 9/2024 | Diard | A43B 13/026 |
| 2026/0041194 | A1* | 2/2026 | Werremeyer | A43B 13/12 |

* cited by examiner

FOOTWEAR SOLE ASSEMBLY

PRIORITY

This application claims domestic benefit from provisional application No. 63/681,212, filed Aug. 9, 2024, and incorporated by reference.

FIELD OF INVENTION

This invention is in the field of orthopedic footwear sole assemblies used to improve stride stability of the user and gait propulsion for the user.

BACKGROUND

The ground contact of a foot during a stride involves the steps of: (1) heel contact; (2) forefoot loading; (3) mid-stance; and (4) propulsion. At heel contact, the foot absorbs shock and may pronate or supinate to maintain contact with the ground. Pronation is when the foot turns inward and supination is when the foot turns outward.

Conventional footwear assemblies provide for a softer or cushioned upper sole element, with a rigid lower sole element or outsole to absorb and disperse the impact of a heel strike. While a softer upper sole element may provide a more comfortable feel for the user, the increased softness frequently reduces overall stability.

Orthotic inserts are known to provide additional support for the foot within footwear. Often such inserts are inserted into existing footwear, and require a counter and full shoe upper to keep them in position.

In U.S. Pat. No. 8,474,154, an improved footwear outsole is disclosed for providing stability for the foot during stride, providing guidance from heel strike to toe off, and preventing pronation and supination. However, the disclosed outsole does not provide sufficient cushioning directly under the heel, whereas the new invention has a soft center area which runs from heel through forefoot, promoting self-centering of the foot. The disclosed outsole also lacks medial/lateral support in the forefoot, whereas the new invention has a firm guide that runs from heel to toe, encapsulating the foot as it sits on the soft center area.

It is the purpose of the present invention to provide an orthotic sole assembly that cushions the heel and enhances guidance of the foot during the stride.

An object of the present invention is to retain the advantages of walking with a rolling action while at the same time providing enhanced cushioning and propulsion at heel strike. It is important that the footwear of the invention differs as little as possible in external appearance from traditional shoes. In particular, an object of the invention is to enable a controlled dynamic, rolling gait.

Another objective of the described technology is to provide stable medial and lateral support in the forefoot, even in footwear styles with minimal heel counters.

SUMMARY

A sole assembly for footwear, comprising a footbed made of a first resilient material having a first durometer that provides a load-bearing surface for the plantar area of a user's foot, with a rocker frame of a second resilient material having a higher durometer surrounding and extending above the footbed along medial and lateral sides. A medial rolling element projects from the bottom of the frame on the medial side, forming a first longitudinal curve with a downward convex face. A lateral rolling element projects from the bottom of the frame on the lateral side, forming a second longitudinal curve with a downward convex face. Each curve extends from the heel to the midfoot. During a stride, ground contact starts at the rear ends of the medial and lateral rolling elements and moves forward across the midfoot. This design improves heel-to-toe motion throughout the stride.

The extensions of the rocker frame control the foot, mitigating both pronation and supination. Throughout the gait cycle, impact forces will follow a path of least resistance and remain centered over the softer footbed, while the harder density rocker frame promotes forward motion and prevents roll-over toward either lateral or medial sides.

In another embodiment, a stiffening plate is proved beneath the softer footbed to provide torsional stability, and minimize flexion of the forefoot. The stiffening plate is preferably "Y" shaped, with a base at the heel, and a split or fork at the midfoot, with extensions extending outward toward the medial and lateral sides.

In yet another embodiment, a second medial rolling element and a second lateral rolling element form additional convex curves from the midfoot to the toe, spaced laterally from each other. These additional convex curves provide additional support and control to the user's gait.

The present invention puts a rolling element into the sole assembly of footwear. The sole assembly can be designed such that it contains this rolling element in an integrated way. The rolling element extends along at least a portion of the side of the footwear, and presents a curve directed downward, starting at the heel area and ending in the midfoot area. The rolling element is made at least partially of an elastic material, for example an elastomer such as rubber or polyurethane. The rolling element provides enhanced heel-to-toe motion during a stride, from heel strike to toe off.

The rolling element is on both sides of the sole assembly, but not directly under the heel, unlike the rolling element in U.S. Pat. No. 8,474,154. In the present invention, the rolling element is not present through the center of the upper layer, but forms a frame around the center. The resulting dual (medial and lateral) rolling elements enable the required rolling action of the foot throughout the stride.

In a preferred embodiment, the invention includes an outsole that, when no load is applied, is broad and substantially flat from under the heel to the ball of the foot, providing a stable platform.

DRAWINGS

The attached drawings are for illustrative purposes only, and are provided in order to aid an understanding of the invention. The figures are not intended to convey a limitation or definition of the claimed invention.

DETAILED DESCRIPTION

Figure 1:
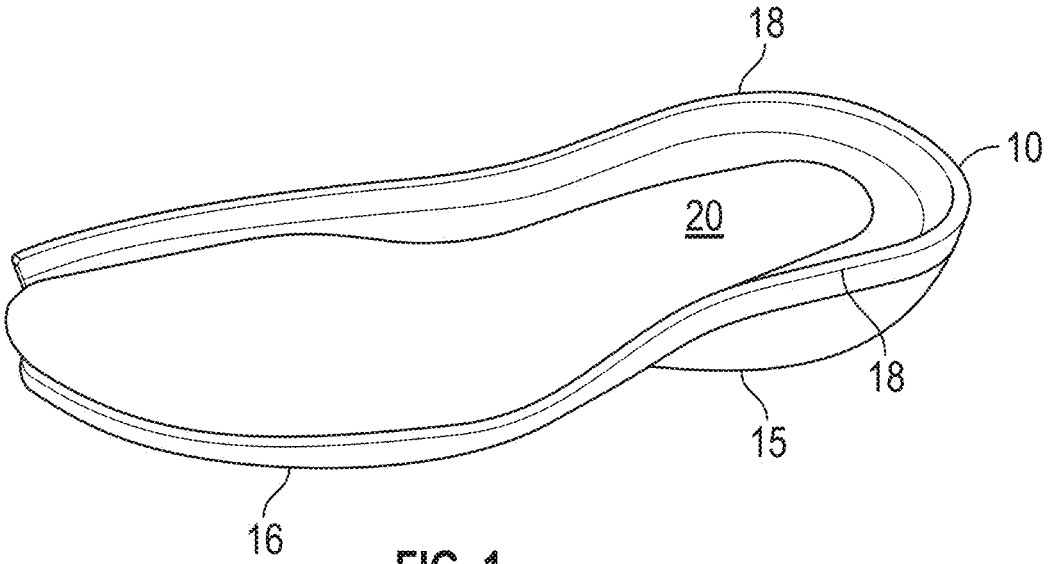
FIG. 1 is a perspective view of the upper layer of the sole assembly.
Figure 2:
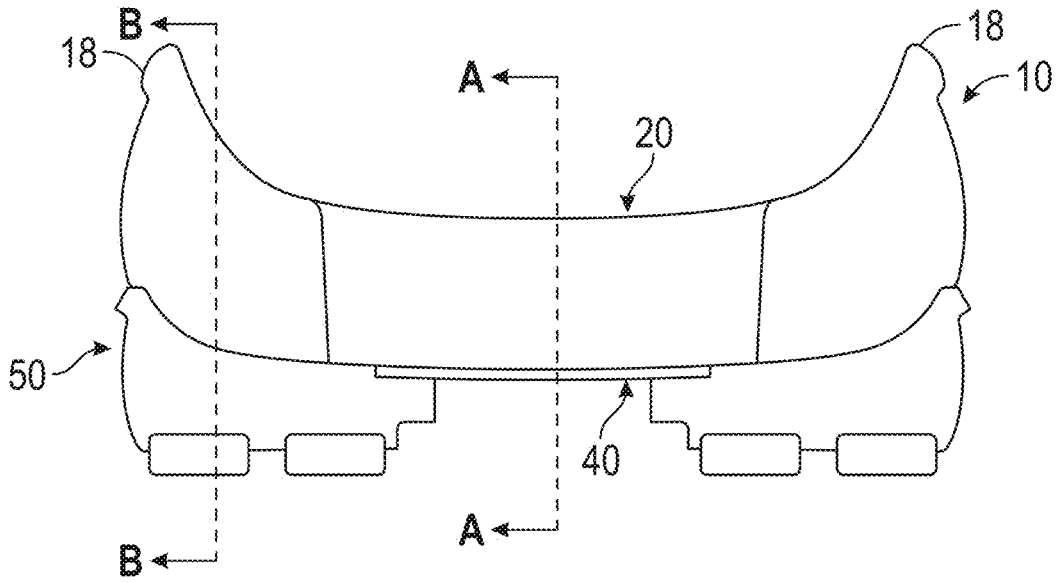
FIG. 2 is a cross-sectional view of the heel area of the sole assembly.
Figure 3:
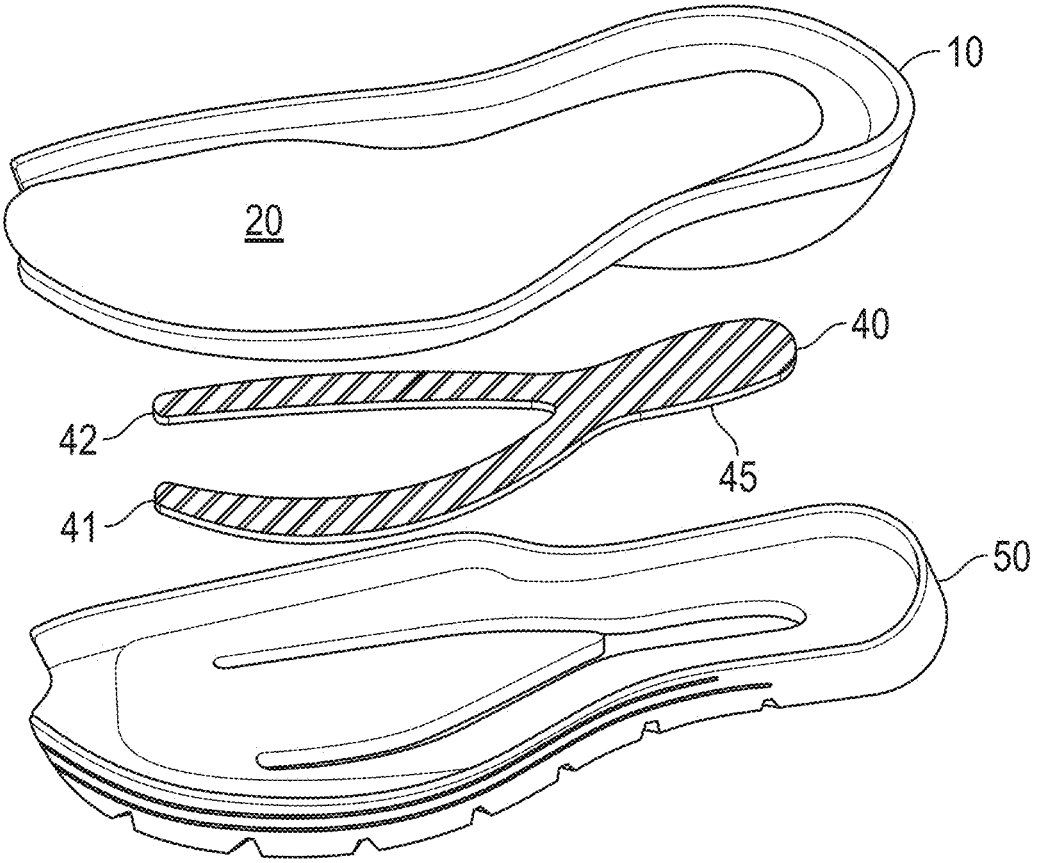
FIG. 3 is an exploded view of the sole assembly.
Figure 4:
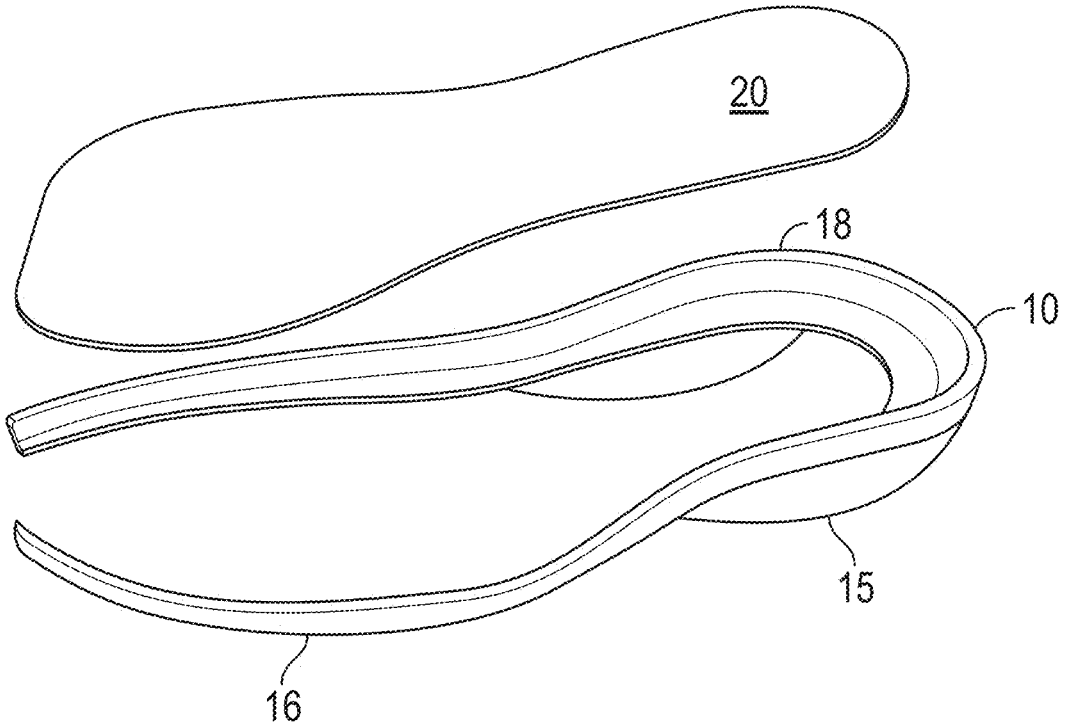
FIG. 4 is an exploded view of the upper layer of the sole assembly.
Figure 5:
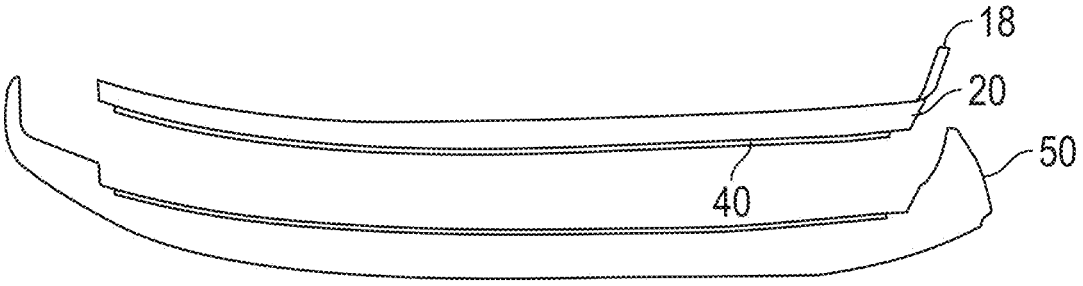
FIG. 5 is an exploded side cross-sectional view along line A-A of FIG. 2.
Figure 6:
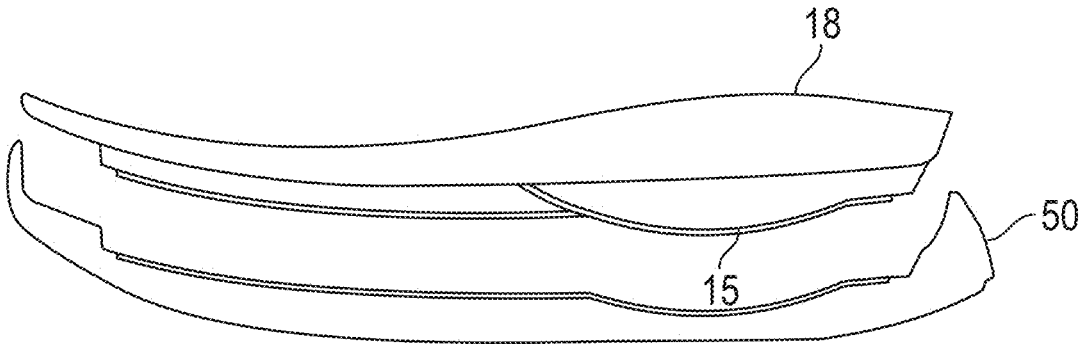
FIG. 6 is an exploded side cross-sectional view along line B-B of FIG. 2.
Figure 7:
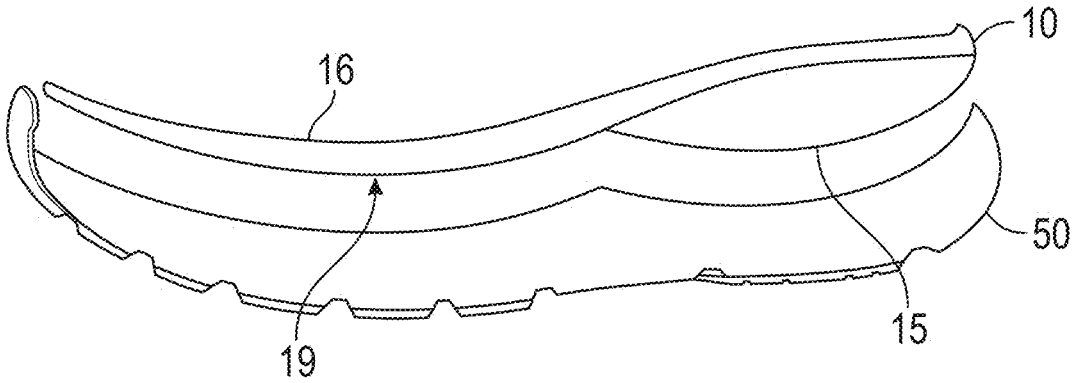
FIG. 7 is a exploded side view of the sole assembly.

The present detailed description provides an in-depth explanation of the subject matter, which pertains to the field of orthopedic footwear sole assemblies designed to enhance stride stability and gait propulsion. The described technology addresses challenges associated with foot pronation, supination, and impact absorption during the gait cycle, offering a novel solution that combines cushioning, stability, and forward propulsion in a seamless and integrated manner.

The invention is a sole assembly consisting of a rigid rocker foot frame 10 forming a periphery, with a softer footbed 20 within the rigid rocker foot frame 10.

The softer footbed 20 provides enhanced cushioning, as it is preferably comprised of a resilient material. The compression of the softer footbed 20 keeps the foot properly centered within the rocker frame 10 during a stride.

Upon heel strike during a user's stride, the impact forces of the user's heel are centered over the softer footbed 20, with the rigid rocker foot frame 10 guiding the foot into a neutral position throughout the gait cycle. The rigid rocker foot frame 10 has a firmer density perimeter for stable guidance through the gait cycle. The durometer of the rigid rocker foot frame 10 is higher than the durometer of the softer footbed 20.

The rigid rocker foot frame 10 cradles the foot and provides medial-lateral support for the foot. The medial-lateral support prevents both pronation and supination, keeping the foot in a neutral position, while the dual medial-lateral rolling elements propel the foot forward.

The rigid rocker foot frame 10 provides stability to the user's foot, while the softer footbed 20 absorbs impact forces and provides cushioning during a step or stride. Rocker foot frame 10 includes vertical extensions 18, which extend upwards at the sides of the shoe upper for added stability, and provide a cradle for the user's foot. Vertical extensions 18 control the heel position at heel strike helping to guide the foot into a neutral position helping reduce over pronation or supination. The continuous cradling profile of the rocker foot frame 10 over the length of the shoe ensures greater walking stability.

The rigid rocker foot frame 10 includes rolling elements 15 on both medial and lateral sides of the sole assembly. Rolling elements 15 extend downward and form convex lower surfaces that provides a controlled rolling motion from heel strike to midstance. The two rolling elements 15 are arranged to define independent medial and lateral rocker paths that operate in parallel during a stride. The medial rolling element initiates pronation control, while the lateral rolling element guides supination, rather than functioning as a single transverse roller. The curved rolling elements 15 of the rocker foot frame promote a rolling effect during a stride.

Rocker foot frame 10 extends along the medial and lateral sides and beyond the rolling elements 15. Frame extensions 16 of rocker foot frame 10 continue to the forefoot, providing stability in the gait cycle, mitigating pronation and/or supination, and preventing flexion of the forefoot. The frame extensions 16 also keep the foot centered over the softer footbed 20.

In an alternate embodiment, frame extensions 16 of the rigid rocker frame 10 include second rolling elements 19, beginning at the midfoot and ending at the toe region, with a second rolling element 19 on each of the medial and lateral sides. Preferably second rolling elements 19 does not present as deep of a downward curve as the primary rolling elements 15. Second rolling elements 19 aids the gait transition from mid-foot to toe off in a neutral position, compensating for over pronation or supination.

In one embodiment, a "Y" shaped rigid support 40, minimizes flexion of the forefoot and promotes greater propulsion at toe-off. The base 45 of the "Y" starts at the heel area, preferably at the center of the heel strike area, and extends longitudinally to the toward the ball of the midfoot area of the sole assembly. Rigid support 40 splits or forks at the midfoot around the arch area, providing a pair of extensions 41 and 42 along the forefoot, extending toward the medial and lateral sides.

Rigid support 40 provides longitudinal support for the sole assembly, preventing the softness of the sole assembly from lessening the stability of the footwear, and helps transfer some of the rotational forces of the rolling elements to be absorbed into the lower midsole and diffuse the load forces of the user's stride. Rigid support 40 also stores potential energy as the structure flexes during the gait cycle, and the potential energy releases at the end of the stride, providing additional propulsive force to the user's stride.

At the arch area, the rigid support 40 splits into extensions 41 and 42. Extensions 41 and 42 of the rigid support 40 extend toward the medial and lateral sides of the sole assembly, preferably extending past the metatarsal region, and in a further preferred embodiment, to terminate near the first and fifth metatarsal heads. Extensions 41 and 42 assist in evening out the pressure across the forefoot area during toe-off.

Extensions 41 and 42 provide stability to the footwear, and as the extensions are flexed during the stride, the potential energy stored in the extensions by flexing will, upon release of that potential energy, provide additional propulsion at the end of the stride. The combination of these characteristics provides the foot with a proper guidance system throughout the gait cycle, and provides propulsive force to the user's stride.

The rigid support 40 provides torsional stability and the extensions 41 and42 reduce flexion in toe-off of the user's stride. The rigid support may also provide therapeutic relief for the following conditions: forefoot neuropathy, hallux ridgus, metatarsalgia, and plantar fasciitis.

The unique design benefits the foot, ankle, knee, hip and lower back by promoting forward motion and providing heel-to-toe guidance, support, and stability under the foot. In particular, the design promotes stability for a user's stride in three phases of the stride.

At heel strike, the design is uniquely suited to help both pronation and supination via the dual-density assembly which dynamically cradles the foot from heel to toe, and subtly guiding the foot through a rolling gate cycle. No other footwear has this design element or provides the functionality. The unique convex design of the harder durometer rocker foot frame, engages at heel strike, and promotes forward motion. While at the same time, the softer lower portion of the midsole provides shock absorption.

At midstance, the firmer rocker foot frame cradles the foot and adds torsional stability through the midfoot, providing better balance by guiding the foot forward in a neutral position to keep the foot, ankle, knees and hips in alignment.

At toe-off, the "Y" shaped rigid support stiffens the forefoot, providing stability against pronation and supination, and reducing further forefoot flexion, by limiting the.

In an alternate embodiment, a lower layer 50 is provided beneath the rigid rocker frame 10 and footbed 20. Preferably, the lower layer 50 has a lower durometer than that of the rocker frame 10. While lower layer 50 will compress during a stride, having a lower durometer than that of the rigid rocker frame 10 allows the rigid rocker frame 10 to compress the lower layer 50, and aid the rolling effect of rolling elements 15. The compression of the lower layer 50 upon heel strike also creates stored energy due to a resistance of the lower layer 50 against said compression. As the user's stride progresses toward toe lift, and pressure on the heel area decreases, the stored energy in lower layer 50 helps push against the user's heel, providing a bounce or propulsion effect.

The embodiments and examples described herein are provided for illustrative purposes only and are not intended to limit the scope of the subject matter. Certain details, well-known to those skilled in the art, may be omitted for clarity and brevity. Furthermore, various modifications, substitutions, and rearrangements of components or features described herein may be made without departing from the spirit and scope of the subject matter, as defined by the appended claims.

The invention claimed is:

1. A sole assembly for footwear comprising:

a footbed made of a first resilient material of a first durometer, the footbed providing a surface for the plantar area of a user's foot;

a frame surrounding and extending above the footbed, the frame comprising a second resilient material of a second durometer, where the frame is capable of cradling a user's foot;

where the second durometer is higher than the first durometer, where the frame extends around and from a heel area of the footwear, along medial and lateral sides of the footwear, toward a toe area of the footwear;

a medial rolling element extending from a bottom of the frame on the medial side, the medial rolling element defining a first longitudinal curve with a first convex face directed downward; and a lateral rolling element extending from a bottom of the frame on the lateral side, the lateral rolling element defining a second longitudinal curve with a second convex face directed downward;

where the first and second longitudinal curves extend along a length of the footwear, each with a first end at the heel area, and a second end at a midfoot area of the footwear.

2. The sole assembly for footwear of claim 1, where the first and second longitudinal curves are laterally spaced from each other.

3. The sole assembly for footwear of claim 1, further comprising:

a rigid support beneath the footbed, with a base of the rigid support extending from a heel area of the footwear toward a toe area of the footwear, where the rigid support comprises medial and lateral extensions, the medial and lateral extensions extending off of the base of the rigid support, at a midsole area of the footwear, with the medial extension extending toward a medial side of the footwear, and the lateral extension extending toward a lateral side of the footwear.

4. The sole assembly for footwear of claim 3, where the medial extension extends to a medial side forefoot metatarsal head area of the footwear; and the lateral extension extends to a lateral side forefoot metatarsal head area of the footwear.

5. The sole assembly for footwear of claim 1, further comprising:

a second medial rolling element extending from a bottom of the frame on the medial side, the second medial rolling element defining a third longitudinal curve with a third convex face directed downward; and a second lateral rolling element extending from a bottom of the frame on the lateral side, the second lateral rolling element defining a fourth longitudinal curve with a fourth convex face directed downward, where the third and fourth longitudinal curves extend along a length of the footwear each with a first end at a midfoot area of the footwear and a second end at the toe area of the footwear, and where the third and fourth longitudinal curves are laterally spaced from each other.

6. A sole assembly for footwear, comprising:

an upper layer comprised of a first resilient material having a center region having a first durometer and a perimeter region having a second durometer wherein the second durometer is higher than the first durometer, the firmer perimeter region defining a rocker foot frame extending along medial and lateral sides from a heel area of the footwear sole assembly to a forefoot area;

a medial rolling element extending downward from the rocker foot frame on the medial side, the medial rolling element defining a first longitudinal curve with a first convex face directed downward;

a lateral rolling element extending downward from the rocker foot frame on the lateral side, the lateral rolling element defining a second longitudinal curve with a second convex face directed downward, the rocker foot frame forming an upward continuous wall, defining an area configured to cradle a wearer's foot;

a lower layer comprised of a resilient material disposed beneath the upper layer, the lower layer configured to compress upon heel strike and store energy for propulsion during toe-off;

wherein, upon heel strike of a stride, the rocker foot frame promotes a rolling motion to guide the wearer's foot in a neutral alignment from heel strike through toe-off.

7. The sole assembly for footwear of claim 6, further comprising:

a rigid support plate comprised of a rigid material extending from the heel area to the forefoot area, the rigid support plate including a base portion and a fork portion, where the fork portion branches toward the medial and lateral sides of the forefoot area to reduce flexion therein; and wherein the firmer perimeter region of the upper layer cooperates with the rigid support plate to provide lateral and medial stability throughout the wearer's gait cycle.

8. The sole assembly for footwear of claim 6, further comprising:

a second medial rolling element extending from a bottom of the rocker foot frame on the medial side, the second medial rolling element defining a third longitudinal curve with a third convex face directed downward; and a second lateral rolling element extending from a bottom of the rocker foot frame on the lateral side, the second lateral rolling element defining a fourth longitudinal curve with a fourth convex face directed downward, where the third and fourth longitudinal curves extend along a length of the footwear each with a first end at a midfoot area of the footwear and a second end at the toe area of the footwear, and where the third and fourth longitudinal curves are laterally spaced from each other.

9. A sole assembly for footwear comprising:

a footbed made of a first resilient material of a first durometer, the footbed providing a surface for the plantar area of a user's foot;

a frame surrounding and extending above the footbed, the frame comprising a second resilient material of a second durometer, where the frame is capable of cradling a user's foot;

where the second durometer is higher than the first durometer, where the frame extends around and from a heel area of the footwear, along medial and lateral sides of the footwear, toward a toe area of the footwear;

a medial rolling element extending from a bottom of the frame on the medial side, the medial rolling element defining a first longitudinal curve with a first convex face directed downward; and a lateral rolling element extending from a bottom of the frame on the lateral side, the lateral rolling element defining a second longitudinal curve with a second convex face directed downward;

where the first and second longitudinal curves extend along a length of the footwear, each with a rearmost end at the heel area, and a forward end at a midfoot area of the footwear; and wherein, during a walking or running stride, ground-contact first occurs on the rear-most ends of the medial and lateral rolling elements, followed by progressive anterior contact along said medial and lateral rolling elements transfer across the midfoot.

10. The sole assembly for footwear of claim 9, wherein the frame forms an upward continuous wall along the medial and lateral sides configured to cradle the user's foot.

11. The sole assembly for footwear of claim 9, further comprising:

a rigid support beneath the footbed, the rigid support comprising:

a base extending from the heel area toward the midfoot area; and a pair of extensions extending laterally toward the medial and lateral sides in a forefoot region.

* * * * *